US005940048A

United States Patent [19]

Martek

[11] Patent Number: 5,940,048

[45] Date of Patent: Aug. 17, 1999

[54] CONICAL OMNI-DIRECTIONAL COVERAGE MULTIBEAM ANTENNA

[75] Inventor: Gary Allen Martek, Kent, Wash.

[73] Assignee: Metawave Communications Corporation, Redmond, Wash.

[21] Appl. No.: 08/680,992

[22] Filed: Jul. 16, 1996

[51] Int. Cl.[6] ..... H01Q 21/00; H01Q 21/20

[52] U.S. Cl. ..... 343/893; 343/799; 343/853

[58] Field of Search ..... 343/700 MS, 754, 343/778, 846, 848, 853, 895, 893, 799, 872

[56] References Cited

U.S. PATENT DOCUMENTS

| | | | |
|---|---|---|---|
| 3,710,329 | 1/1973 | Mailloux et al. | 343/853 |
| 4,101,895 | 7/1978 | Jones, Jr. | 343/700 MS |
| 4,162,499 | 7/1979 | Jones, Jr. et al. | 343/700 MS |
| 4,316,192 | 2/1982 | Acoraci | 343/100 |
| 4,792,808 | 12/1988 | Hilebrand | 343/853 |
| 4,799,065 | 1/1989 | Thompson | 343/853 |
| 4,816,836 | 3/1989 | Lalezari | 343/700 MS |
| 4,962,383 | 10/1990 | Tresselt | 343/700 MS |
| 4,980,692 | 12/1990 | Rudish et al. | 343/700 MS |
| 5,552,798 | 9/1996 | Dietrich et al. | 343/893 |
| 5,650,788 | 7/1997 | Jha | 343/700 MS |

*Primary Examiner*—Don Wong
*Assistant Examiner*—Tan Ho
*Attorney, Agent, or Firm*—Fulbright & Jaworski L.L.P.

[57] ABSTRACT

An omni directional coverage multibeam antenna relief on a ground surface having simple conical shapes to provide beam steering. One advantage of such a system is that the projected area is always constant and broadside to the intended direction resulting in limited scan loss effects. In the case of a cylinder as the conical shape, z-axis symmetry provides a constant antenna aperture projection in any azimuthal direction. Using this geometry, high level, side lobes are reduced considerably because of the natural aperture tapering from dispersion effects. Coverage area and power can be controlled by changing the ground surface angle and by selectively activating different antenna beam positions around the circumference of the ground surface, and by selectively changing the phase relationship between a given set of antenna beams.

37 Claims, 14 Drawing Sheets

FIG. 8b
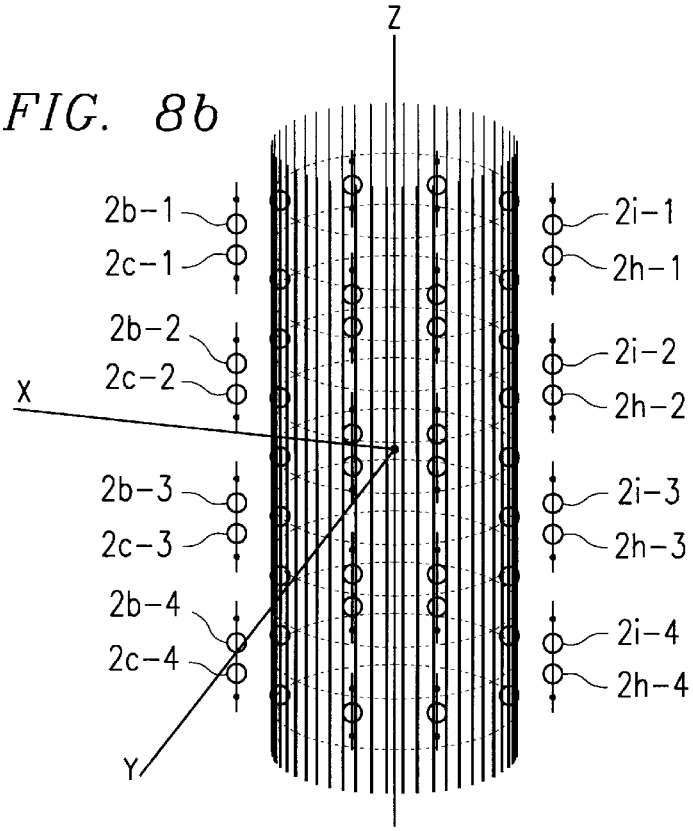
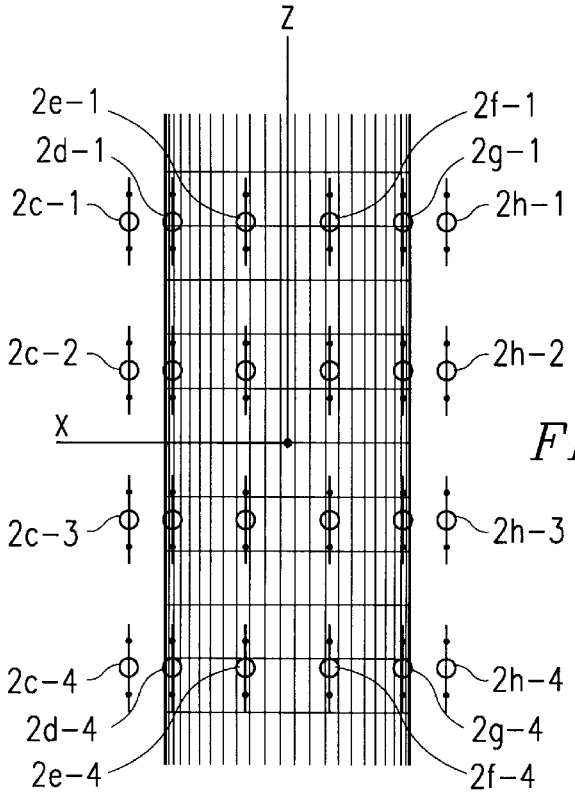
FIG. 8c

IDEALIZATION

DIODE SWITCHED CIRCUIT

CONICAL OMNI-DIRECTIONAL COVERAGE MULTIBEAM ANTENNA

TECHNICAL FIELD OF THE INVENTION

This invention relates to coaxial cable fed multibeam array antennas and more particularly to antennas employing a conical shaped geometry to effect omni-directional composite coverage when all beams are superimposed.

BACKGROUND OF THE INVENTION

Planar array antennas when imposed to cover multiple directions, suffer from scan loss. Since the projected aperture decreases as the beam is steered away from the broadside position which is normal to the ground surface and centered to the surface itself, it follows then that broadside excitation of a planar array yields maximum aperture projection. Accordingly, when such an antenna is made to come off the normal axis, the projected aperture area decreases causing a scan loss which is a function of cosine having a value of 1 with the argument of zero radians (normal) and having a value of 0 when the argument is π2.

$$Ant\ \text{Gain}\ db = 10\log\left[\frac{4\pi}{\lambda^2} * \text{Area} * \text{Cos}(\theta)\right]$$

There are a number of methods of beam steering using matrix type beam forming networks that can be made to adjust parameters as directed from a computer algorithm. This is the basis for adaptive arrays. When a linear planar array is excited uniformly to produce a broadsided beam projection, the composite aperture distribution resembles a rectangular shape. When this shape is Fourier transformed in space, the resultant pattern is laden with high level side lobes relative to the main lobe. The $$SINC = \frac{\text{SIN}(x)}{(x)}$$

function is thus produced in the far-field pattern. In most practical applications these high level side lobes are an undesirable side effect.

Accordingly, a need exists in the art for an antenna system which provides for beam steering without using adaptive techniques.

A further need exists in the art for such an antenna system whereby the beam aperture is relatively constant and broadside to its intended direction without producing undesirable high level side lobes.

These and other objects and desires are achieved by an antenna design which relies on the simple geometry of conical shapes to provide a more natural beam steering.

SUMMARY OF THE INVENTION

In one embodiment of my invention, a transmit antenna is constructed as a series of antenna dipole columns mounted in close proximity to the outer surface of a nearby vertical conical shaped electrical ground surface. The ground surface is constructed circumferentially around a mast and the conical "slope" and is such that the ground surface "faces" downward at an angle, thereby creating on the ground a circumference within which the signal is propagated. This entire structure is contained within a single transparent radom. This same circumferential columnar structure can be used for a receiver antenna array constructed within the same radom on the same mast as the transmit antenna and partitioned therefrom. The ground surface angle, or conical angle can be adjusted to contain or limit the coverage area of the intended radiation pattern.

When a group of columns are excited to create a beam, the positive result from this structure is created by the fact that the reflected "image" energy from the outer columns is dispersed when the radius of the ground surface cylinder is in the range of one λ wavelength. So, when the various parallel ray paths are summed together to make the effective aperture distribution, the shape is close to a cosine function and the spatial transform is similar to a Gaussian shaped far-field pattern. Thus, the antenna system achieves lower side lobes in relation to the main lobe, which in most practical cases, is a desirable effect.

Accordingly, no modifications need be made to the outer array columns to effect side lobe level control as is the case with planar arrays. This is a significant improvement over prior art systems where it is common practice is to remove elements from the outer columns or to dissipate this energy into a resistive load to achieve the same amount of side lobe level control.

In one embodiment, the individual columns can consist of any type of radiator: patch, dipole, helical coil, etc. In the case of dipoles elevated above the grounded surface of the cylinder, the effect can be visualized as a circular patch being projected onto a curved surface where the reflected projection is an ellipse with the major axis of the ellipse being a function of the radius used to make up the cylinder. As that radius increases, the amount of dispersion decreases such that as the radius grows to infinity, the system behaves like the common linear planar array. The first side lobe grows in magnitude converging on the value of that seen with a uniformly excited linear array. So, the level of first side lobe leveling control is a function of the radius of the cylinder. Using this as the design objective, the radius of the preferred embodiment should be limited to a value of $$< \frac{3}{2} * \lambda.$$

In some applications, it is desirable to limit the radiation pattern of the antenna system so that a network of such systems can reuse an allocated set of frequencies repeatedly. The cylinder used as an example, could be replaced with a conic section that would be a "frustum of right circular cone". The larger radius of the two radii of the frustum, would be at the top, when mounted longitudinally. This would accommodate the "down-tilt" required for such a system. Other shapes can be used, such as right circular cones or semi-hemispheres to encompass airborne and space applications as well as terrestrial applications.

Beam width and gain are functions of how many radiator columns are driven at the same time from one excitation source. Any number of columns can be excited to effect the desired beam synthesis. The only requirement is that the active (excited) columns, can "see" the projected wave front that it is supposed to participate in. This would determine the maximum number of columns required to effect a specific beam synthesis. The highest gain, narrowest beam is produced when all Pi radian active elements that are driven together can "see" the wave front that they are each to participate in. In the case of a cylinder, these would be the columns that are Pi apart on the circumference. A line drawn between the most outer and most inner columns, sets up the basis upon which the inner columns are phase retarded in order to produce the desired beam synthesis. However, a simulcast on all beams is possible if all "N" ports are excited at the same time.

The intended beam design objectives are based on the number of available adjacent columns to be excited. The narrower the beam, the more columns must be excited, and the more complex the phase retardation network. The simplest approach, is to disregard the image sources projecting off the ground surface and simply introduce the appropriate amount of phase shift on the inner columns to effect a "coherent" phase front in the direction of beam propagation. In this first approach, this works to create a useful pattern. However, the best gain and side lobe relationship is achieved when image source dispersion is taken into account. After the image sources have been adjusted for dispersion factor and ray trace length, a composite delay is assigned to the inner columns.

Accordingly, it is one technical advantage of my invention to provide an antenna system which relies on conical shaping of its ground surface and radiator positions above this ground to eliminate the effects of scan loss.

A further technical advantage of my invention is to construct an antenna array where dispersion effects of the image sources are used to effect first side lobe level control.

A still further technical advantage of my invention is a methodology for designing antenna radiator feed networks that are used to phase delay specific radiator columns to effect far field pattern synthesis.

An even further technical advantage of my invention is the use of a "frustum of a right circular cone" (a right circular cone with its tip blunted), which allows the system to create "down-tilt" where the radiation pattern has to be controlled for spectrum reuse.

A further technical advantage of my invention is to construct the edges of the conic shape to effect elevation surface side lobe level control, thereby positioning destructive nulls into harmless areas. In an alternate method and system, such nulls can be reduced by use of a combination of rounded edges and dissipative material.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIGS. 8*a*–8*c* are wire views of the model used for the method of moments radiation calculations.

DESCRIPTION OF THE PREFERRED EMBODIMENTS

Figure 1:
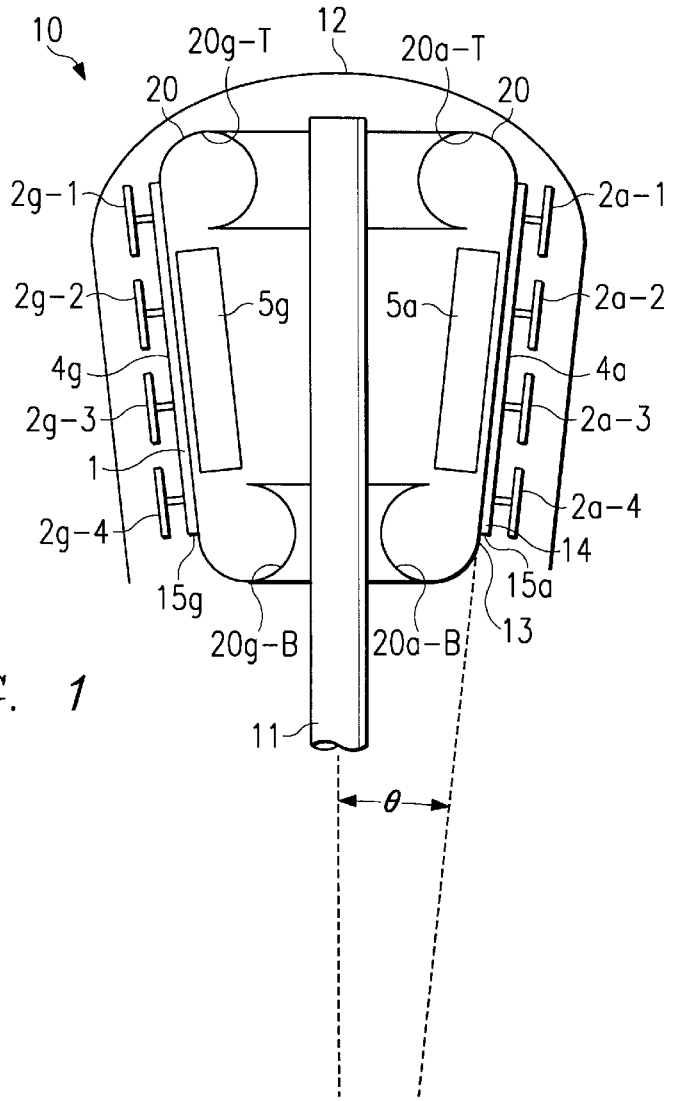
FIG. 1 is an axial cross-sectional view of the preferred embodiment of the inventive antenna.
Figure 2:
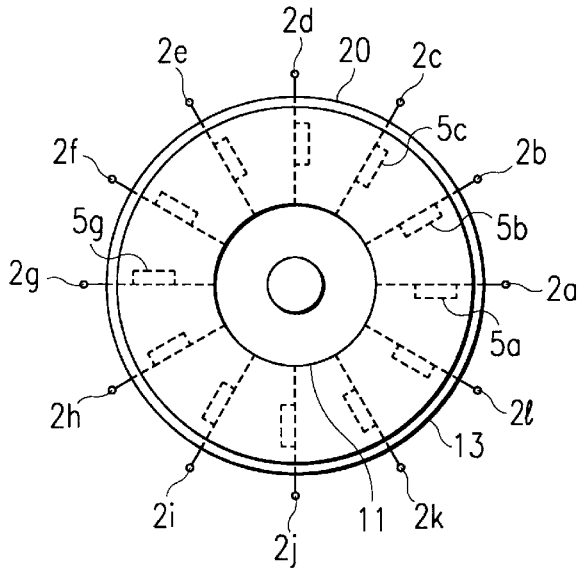
FIG. 2 is a top cross-sectional view of the antenna system shown in FIG. 1.
Figure 4:
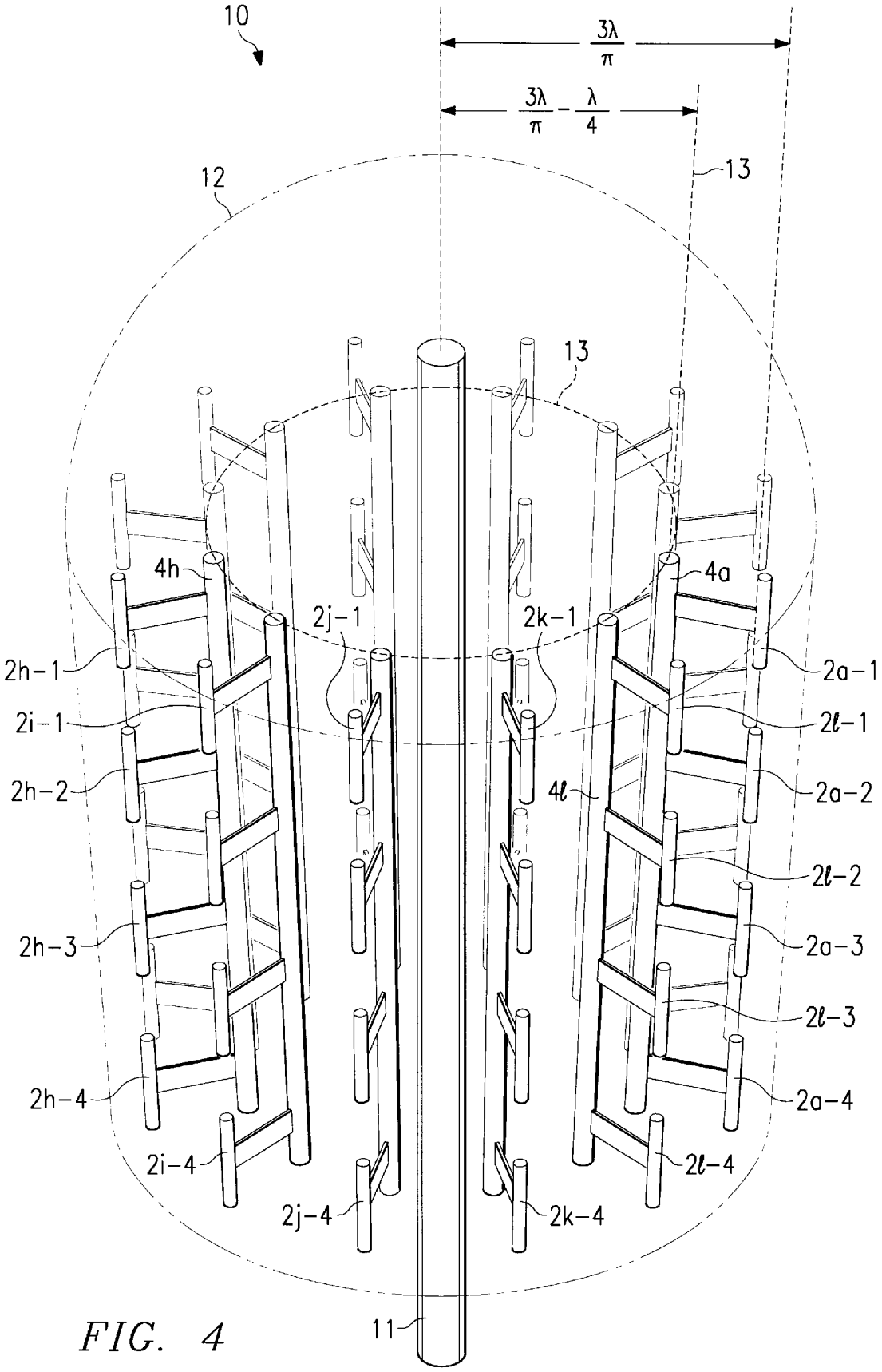
FIG. 4 is a full elevational view of the antenna system shown in FIG. 1.

As shown in FIG. 1, the preferred embodiment of the inventive antenna system 10 is shown having a conical shaped ground surface 13 held by mast 11. Ground surface 13 acts as a circumferential support for column radiators 2*a*–2*l* which are arranged around the peripheral of surface 13, as shown in FIG. 2. FIG. 4 shows a perspective view of antenna system 10. In the example shown, there are twelve vertical column radiators (2*a*–2*l*), each having 4 dipoles in this case, such as dipoles 2*a*-1, 2*a*-2, 2*a*-3 and 2*a*-4 for column 2*a* (FIG. 1). The column radiators are joined together by mounting them on a common feed system such as feed system 4*a* for radiator set 2*a* and feed system 4*b* for radiator 2*b* which in turn is connected by a coaxial connector 15*a*–15*l* which feeds through the wall of conical ground surface 13. Ground surface 13 is shown as a frustum of a right circular cone having angle Θ with mast 11. This angle Θ controls the area of coverage and allows for reuse of the frequencies. Angle Θ could be variable, for example by tilting mast 11, from time to time, to allow for changing conditions.

$$\Theta=\Theta_M+\Theta_E$$

The mechanical $\Theta_M$ is established by the physical structure of the right circular cone. This $\Theta_M$ can be supplemented by a $\Theta_E$ which is an electrical downtilt created by the relative phase relationship among the dipoles making up the vertical column.

A cylinder can be used if the radiator columns are fed in such a way that the individual radiating elements making up the column radiator have the appropriate inter-element phase relationship that produces the desired amount of downtilting. In this case;

$$\Theta=\Theta_E,\ \Theta_M=0$$

Of course this would, in theory, introduce a small amount of "scan-loss" so the physical method would be more appropriate since it would project the greater amount of aperture area.

Figure 11A:
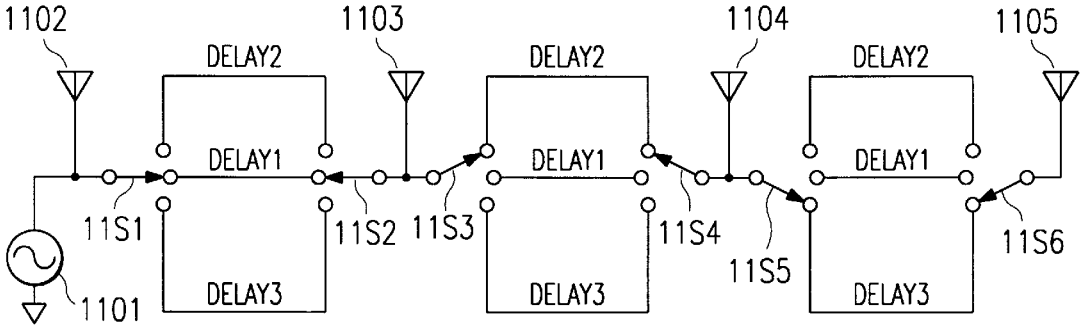
FIGS. 11*a* and 11*b* show a circuit for achieving a variable electrically created phase $\Theta_E$.
Figure 11B:
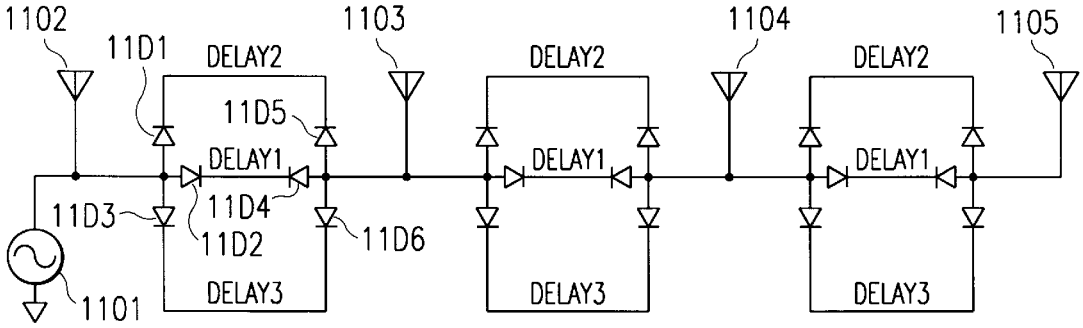

As shown in FIGS. 11*a* and 11*b,* different lengths of connecting transmission line can be "switched in" or "switched out" between the radiating elements making up the column. The different delays (different lengths of line), represent stepped changes in phase shift, since a λ length of line represents a 2π or 360° phase delay (shift). So, by switching in the appropriate lengths via switches 1151–1156, a relative phase shift is created between the radiating elements. This is depicted in FIG. 11*a,* where either delay 1, delay 2, or delay 3 is in the signal path. Where Delay 1<Delay 2 and Delay 2 is <Delay 3. This creates a constant relative phase shift between the energy arriving at the individual radiating elements. This condition makes the combined beam from this column of elements scan away to the right from the normal and parallel to the column axis.

In FIG. 11*b,* the switches have been replaced with diodes (PIN diodes for example), such as diodes 1101–1106 to effect the function of the mechanical switches as depicted in FIG. 11*a.*

Figure 5:
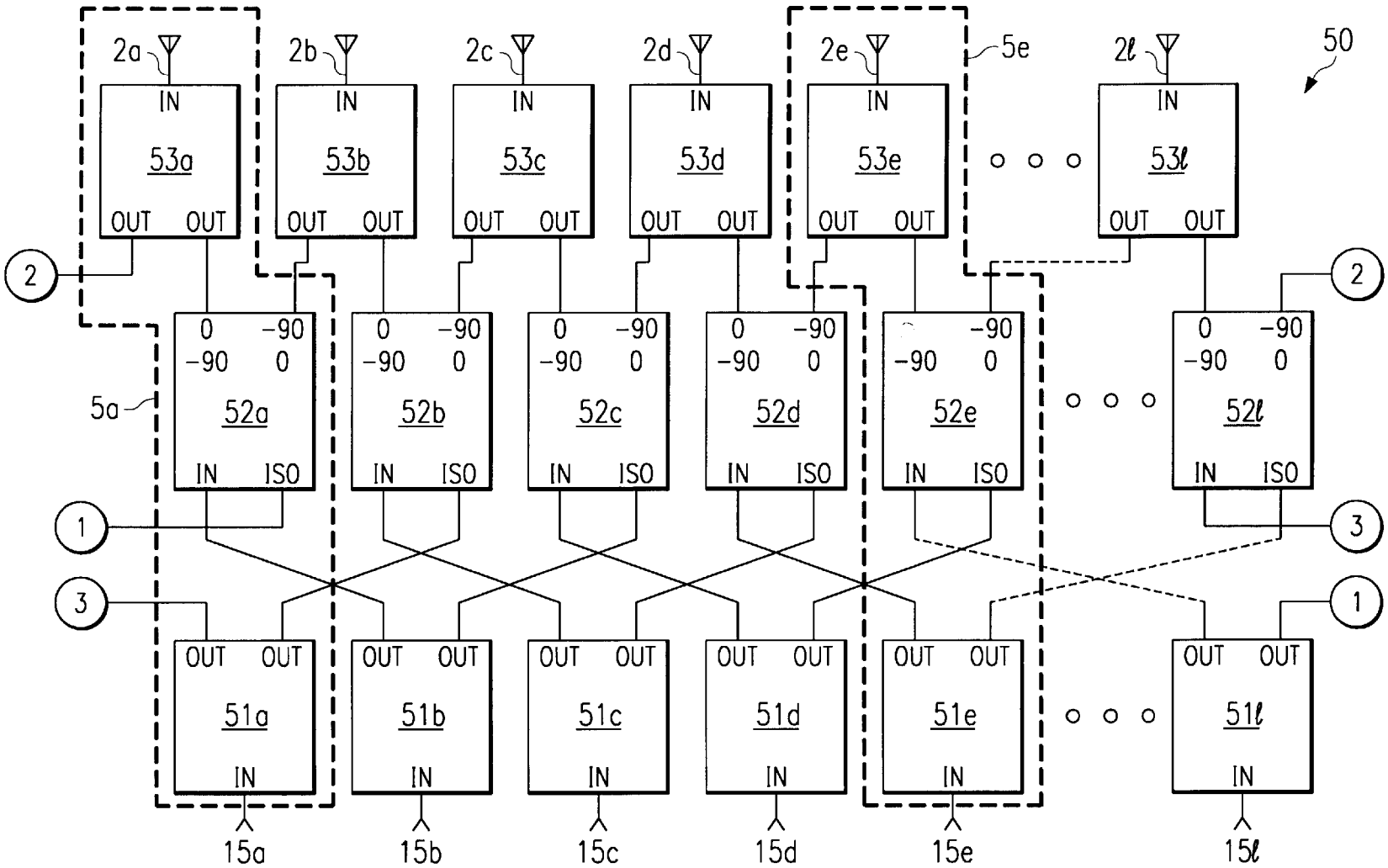
FIG. 5 shows a twelve-column (a–l) non-interleaved feed system for the antenna system shown in FIG. 1.

FIG. 5 shows control for a non-interleaved twelve radiating column system formed to include a four-column excitation. In the case of a transmitter (TX), the energy enters at one or more of the coax connectors 15*a*–15*l.* For each connector, such as connector 15*c,* the energy is equally divided by divider 51*c.* The energy is split evenly and arrives at splitters 52*b* and 52*d.* That energy again is divided by splitting 52*d* and comes out as 0° and −90° and from splitter 52*d* it comes out as −90° and 0°. This energy is then routed to combiners 53*b,* 53*c,* 53*d,* and 53*e,* which illuminates or excites antenna columns 2*b,* 2*c,* 2*d* and 2*e,* respectively. The object is that energy enters connector 15*c* and is supplied to four antenna columns such that reading across from left to right the phase of the energy is at 0° at antenna 2*b,* −90° at antenna 2*c,* −90° at antenna 2*d,* and 0° at antenna 2*e.* This topology creates a beam defined by four antennas which are illuminated in this manner. The relationship between the separate dipoles (2*b*-1, 2*b*-2, etc.) of each column will be discussed in detail hereinafter.

Elements in FIG. 5, labeled 51*a* through 51*l,* are called "Wilkinson combiners". Each of the elements 15*a* through 15*l* have two outputs. Energy coming out of the elements is split but in phase. That is important.

Elements 53*a* through 53*l* are also "Wilkinson combiners". This is an in-phase power splitter. Elements 52*a* through 52*l* have two inputs and two outputs. One input is called "in" and the adjacent one is called "ISO", or isolation. On the output side there is a terminal that is marked zero and one marked −90. When energy comes to the input port, if you go straight up, you go to zero, if you go across to the other port, it is −90. If energy comes straight up from the isolation port, it is at zero (under the −90 mark) and if energy goes across, the devise is at −90 (under the zero mark). This is called a hybrid. The difference between it and the Wilkinson element is the fact that it has two inputs and the outputs have a 90° relationship with each other. That is essential to the functioning of the system and the forming of the beam.

Let's now look at the power flow through the feed system. When you connect a source to a Wilkinson, let's say we are looking at element 51*c,* with a 1-watt source. What will happen is that ½ watt will come out of each output port and in phase. Now with element 53, if we have two ½ watt sources going in, we will have 1-watt coming out. That is a straightforward relationship. This is called coherent combining. In other words, to hook up an energy source at the two outputs of element 53*c,* ½ watt on one side and ½ watt on the other side, they must be in phase and at the same frequency. Let's assume we hook up a 900 MHz ½ watt source on one out port of element 53*c,* as we would for cellular communications. On the other out port of element 53*c,* there is another independent 900 MHz ½ watt source, but also in phase (coherent) with the first 900 MHz source. Those two sources will combine and will come out a 900 MHz, 1-watt combined source.

Now assume we have two sources, one is at 900 MHz ½ watt and one is at 800 MHz ½ watt, each being connected to a respective out terminal of element 53*c.* What comes out to antenna 2*c* is not 1 watt. What happens is a 3 dB is last by each source. This occurs because there is a resistor across the two output ports. When the element senses that there is non-coherent (different frequencies) combining, even though they are each at ½ watt, what comes out is a ¼ watt 800 MHz source, and a ¼ watt 900 MHz source. They are not combined at all. They are just separate entities coming out of the input port to the antenna. When the system has separate transmitters on 15*c* and 15*d,* one could be at 900 MHz and one at 800 MHz, left alone they would create two separate beams. These two beams share antenna 2*d* which is fine, but a 3 dB tax has been paid. The advantage of the non-interlaced column feed is the fact that the antenna structure is straightforward, there are not as many radiating antennas, but a power loss is experienced by this non-coherent combining.

Figure 12:
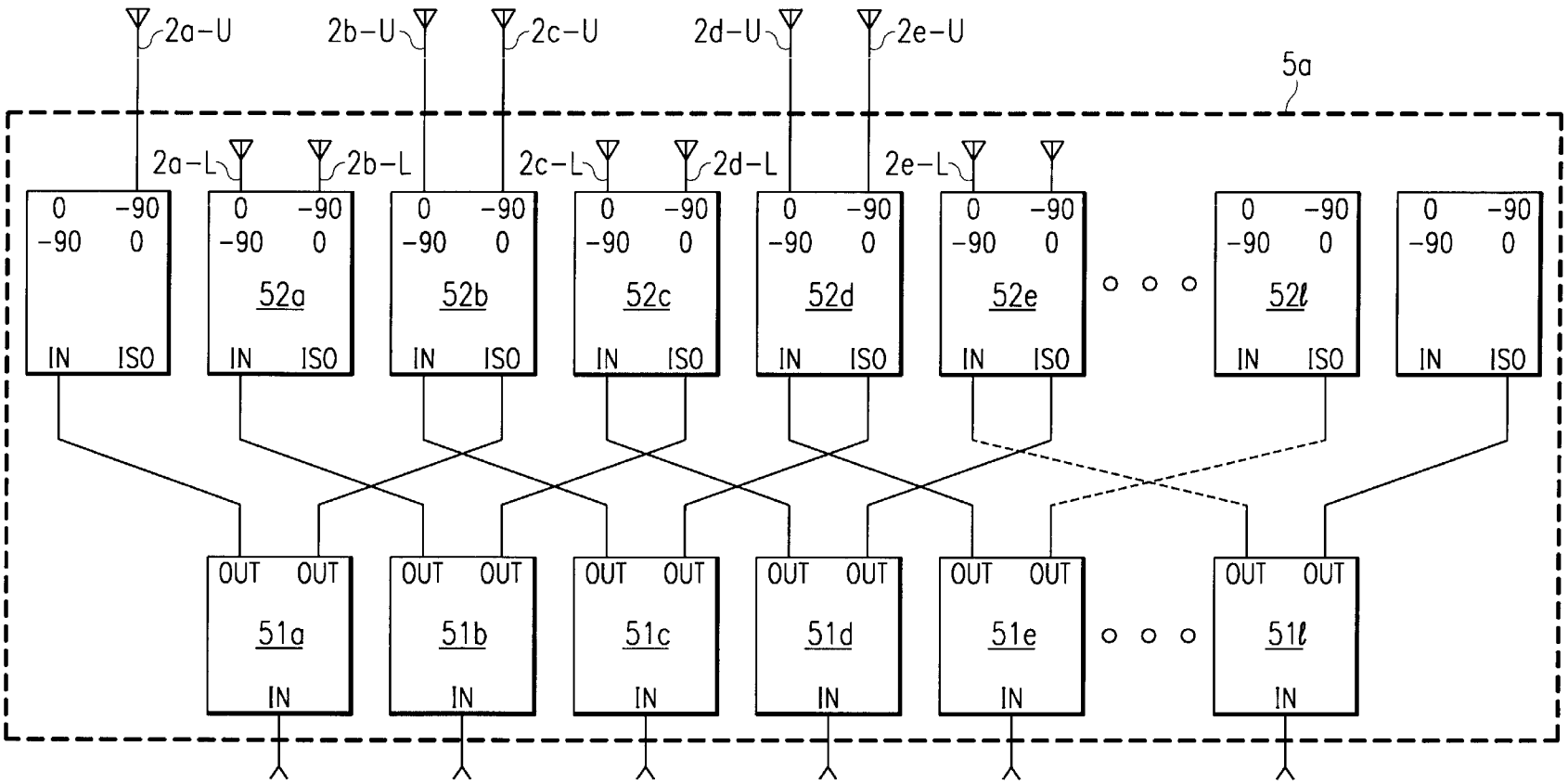
FIG. 12 shows a twelve-column (a–l) interleaved feed system for the antenna system shown in FIG. 13.
Figure 13:
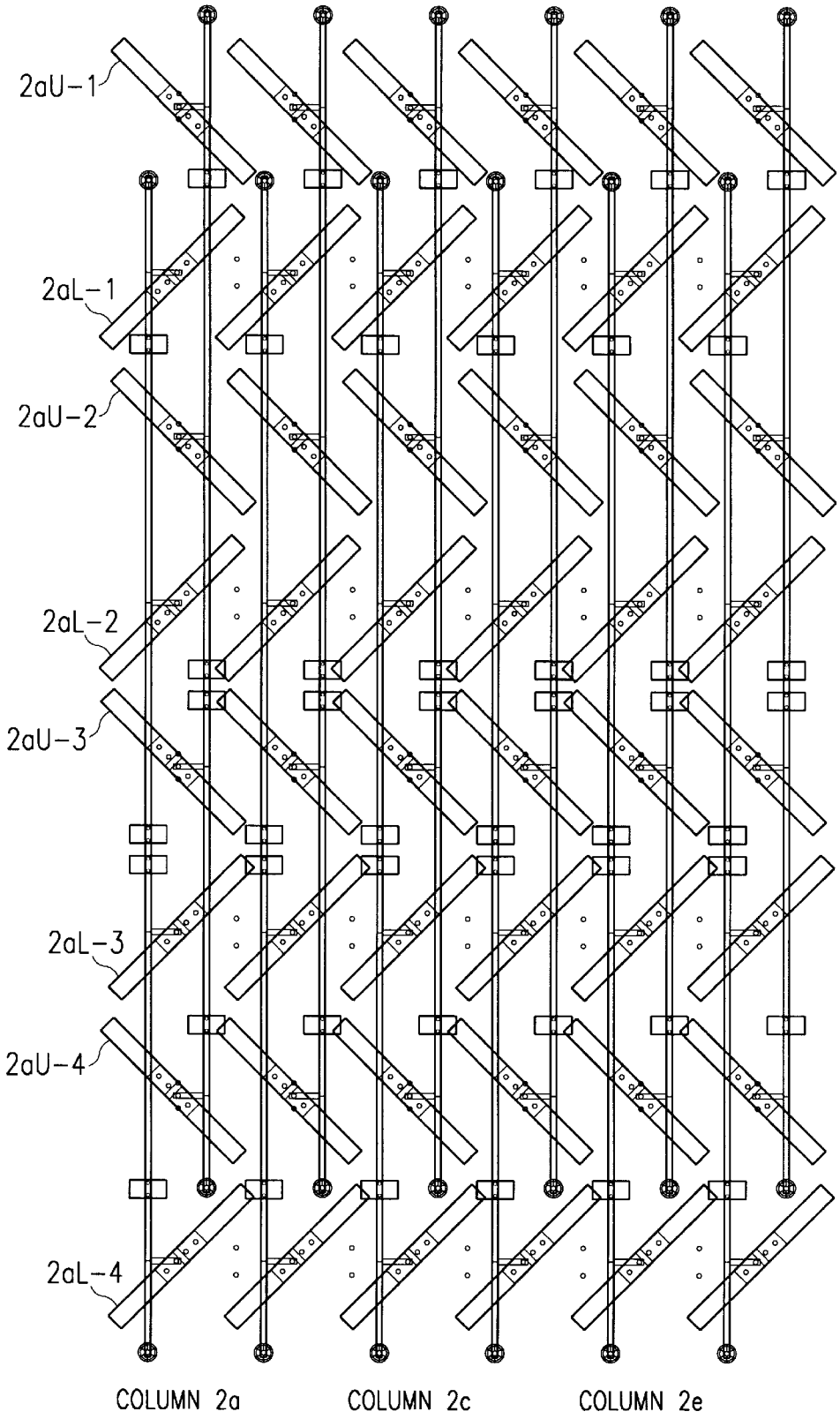
FIG. 13 shows the physical structure of an interleaved antenna system.

In order to avoid the non-coherent combining as discussed above, I have developed an alternate system that uses two antennas per column as shown in FIGS. 12 and 13. This is an alternative to FIG. 5 and uses an interleaved system. As can be seen, there are more antenna symbols such as 2*a*–*u* and 2*a*–*l* for each column. Each column has four elements. This, as shown on FIG. 13 for column 2*a* we have 2*au*1, 2*al*1, 2*au*2, 2*al*2, 2*au*3, 2*al*3, 2*au*4 and 2*al*4.

Returning to FIG. 12, let us look at element 51*c* again which is a Wilkinson. Now we hook up a 1-watt transmitter to it and the power comes out, equally split, ½ watt on each output port, and both of those split signal paths arrive at elements 52*b* and 52*d* in phase. Now, instead of the power going back to a Wilkinson (as with the non-interleaving system of FIG. 5), the power goes directly to the respective antenna 2*b*-U, 2*c*-U, 2*d*-U, and 2*e*-U which are excited with the desired 0°, −90°, −90°, and 0° phase relationship respectively.

It should be clear from the foregoing discussion that FIG. 5 can be used in either direction and, in fact, the same circuit is used for the receive antennas of the system.

Figure 3:
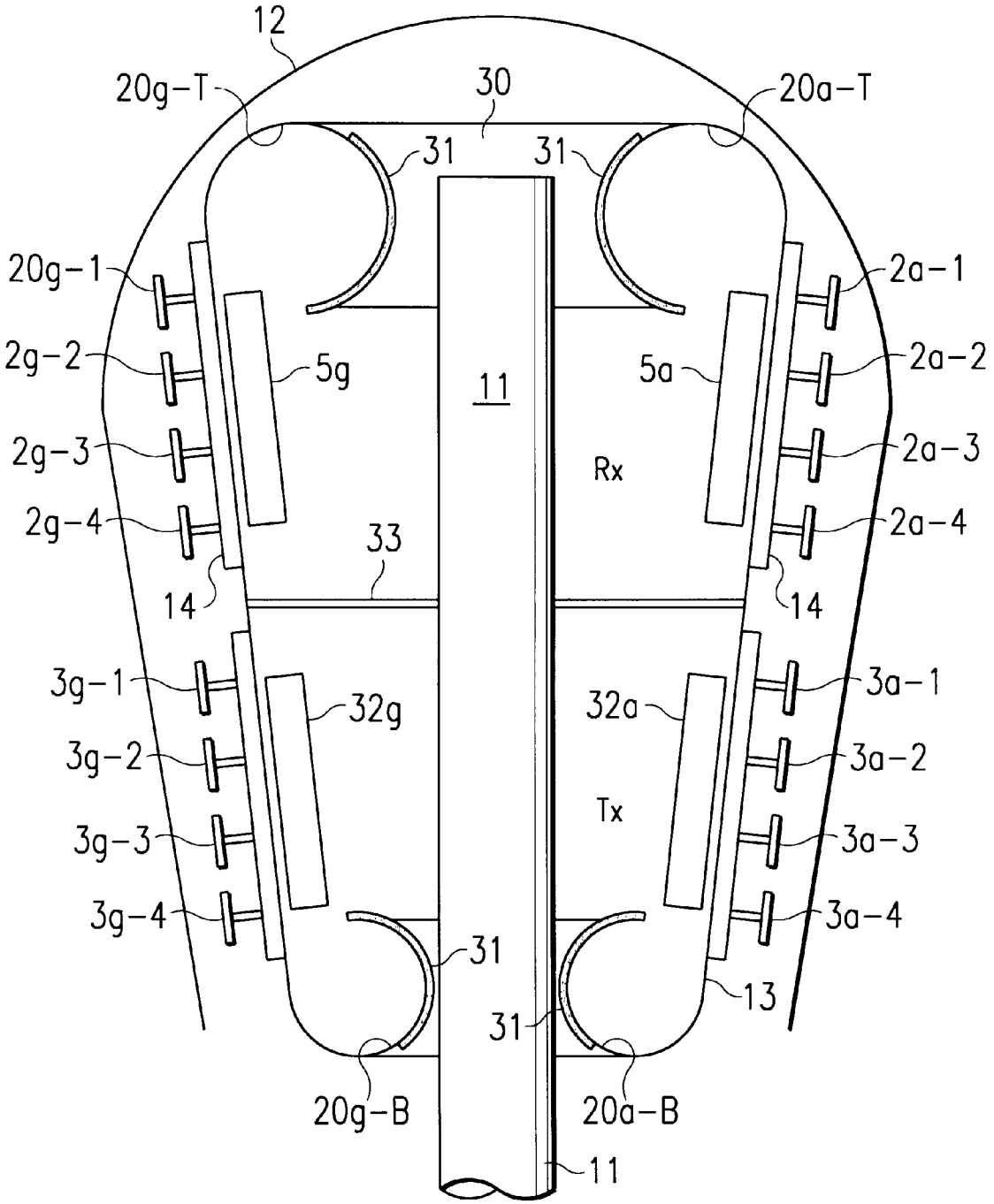
FIG. 3 is an axial cross-sectional view of the compartmentalized version of the inventive antenna, showing separate TX and RX sections.

FIG. 3 shows that the internal compartment 30 of the cylinder can include partition 33 to create a separate transmit and receive system. An example would be to have the upper portion of the system be receive only, while the lower portion would be transmit only. This would afford the elimination of costly and complicated duplexer systems that are used when receivers and transmitter systems share the same antenna system. Two such systems (cylinders in this case) could be separated in space to effect space-diversity, horizontally or vertically. The first side lobes and others can be reduced by the presence of the upper and lower elevation side lobe suppressor torus, as shown in FIG. 3 as elements 20*a*-T(TOP), 20*a*-B(BOT), 20*g*-T and 20*g*-B. The sheet current created as a by-product of the normal function of electromagnetic radiation, can have undesirable side effects, especially if this current sheet happens onto a surface discontinuity such as an edge. The discontinuity then will act as a launch mechanism and convert the sheet current back into propagating radiation. The edge, in the case of a cylinder, acts like two radiating hoop structures, (one on top and one at the bottom of the cylinder) that superimpose their respective radiation patterns onto the desired column radiator pattern. Thus, by having the sheet current follow the curve of the torus, ideally having a radius >λ/4 and when an absorbing material 31 is present to turn this current into heat, the side lobes in the elevation surface can be controlled. Four such suppressors could be used, one in each chamber, for an RX nd TX antenna system, if desired.

In the example of FIG. 12, the columns are to be separated from each other by $$\leq \frac{4}{5}\lambda.$$

Since there are twelve such columns, the circumference of the column radiators is defined, for example use λ/2.

$$\text{Circumference} = 2*\pi*\text{radius} = 12*\left(\frac{1}{2}\right)*\lambda$$

$$\text{radius} = \frac{(3*\lambda)}{\pi}$$

Now, if we choose to normalize the value of λ to equal a value of one, we can use the following numerical values.

$$\frac{(3*\lambda)}{\pi} = 0.9549$$

The above value establishes how far the column radiators should be from the center of the cylinder in the X-Y surface. Since dipoles are being used in this example, and since we choose to have them at λ/4 above the ground surface, the radius of where the ground surface is in relation to the center of the system is established.

$$\frac{(3*\lambda)}{\pi} - \frac{\lambda}{4} = 0.7049 \text{ where } \lambda = 1$$

With the above parameters established we can proceed with the description of the antenna system.

Figure 14A:
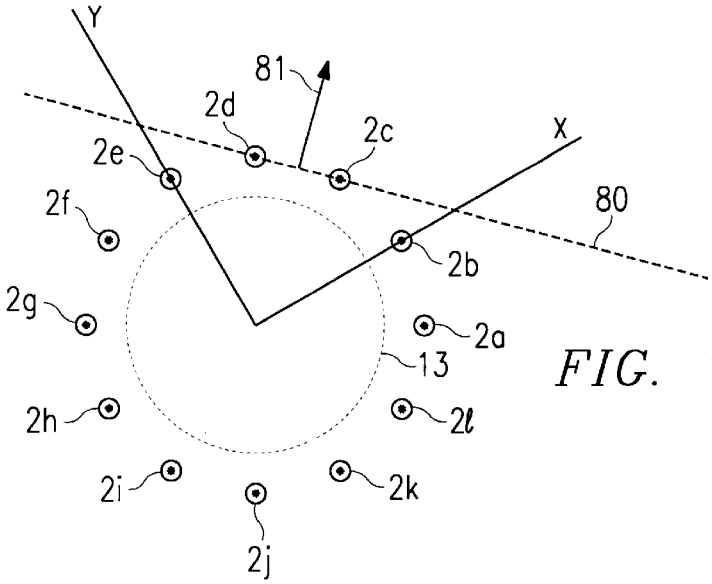
FIGS. 14*a*–14*c* are phase relationship diagrams.

The principle of this antenna system is to generate a wave front by the excitation of the appropriate radiator columns 2*a*–2*l* and by phase shifting (delaying) the "inner" column radiators. In this example, we will synthesize the creation of a planar wave front. Referring to FIG. 14*a,* radiator columns 2*c* and 2*d* are phase retarded by 90° with respect to columns 2*b* and 2*e.* The combined wave front 80 adds in the direction of arrow 81 to produce 2*a* planar wave front.

Figure 14B:
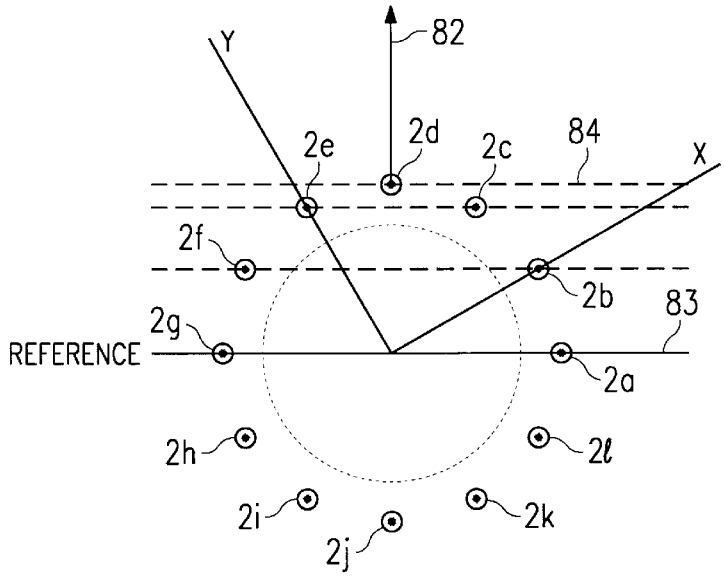
Figure 14C:
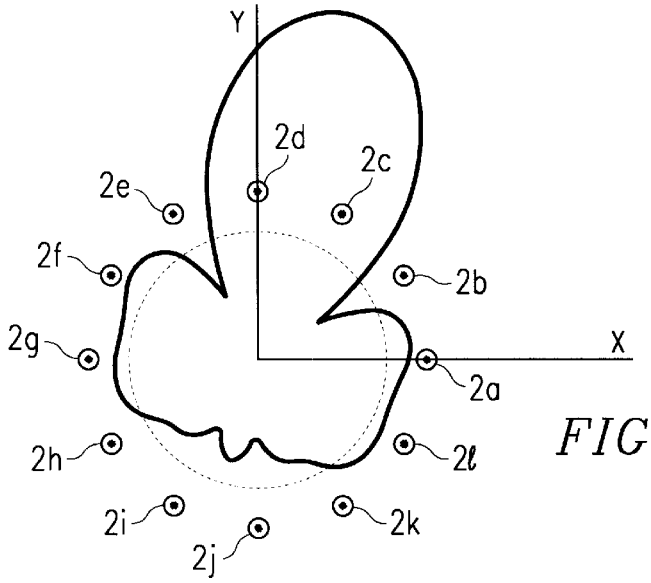

For more columns to be driven, the inner columns (those closest to the wave front) must be delayed in single or in pairs, to match the phase of the most outer column elements. Referring to FIG. 14*b,* we have seven radiator columns (2*a* through 2*g*) involved and the idea here is to synthesize a wave front in the direction of arrow 82. First we retard column 2*d*'s excitation by the angular displacement with respect to a line 83 drawn through points 2*g*–2*a* and its advance parallel line 84 through point 2*d.* Second, we retard columns 2*e* and 2*c* excitation by the angular displacement between line 83 and a parallel line drawn through points 2*c*–2*e.* Thirdly, we retard the excitation of columns 2*f* and 2*b* with respect to line 83. This allows the energy propagating away from line 83 in the direction of arrow 82 to "catch-up" with the energy going in the same direction from the other elements 2*b*–2*f.*

Figure 6A:
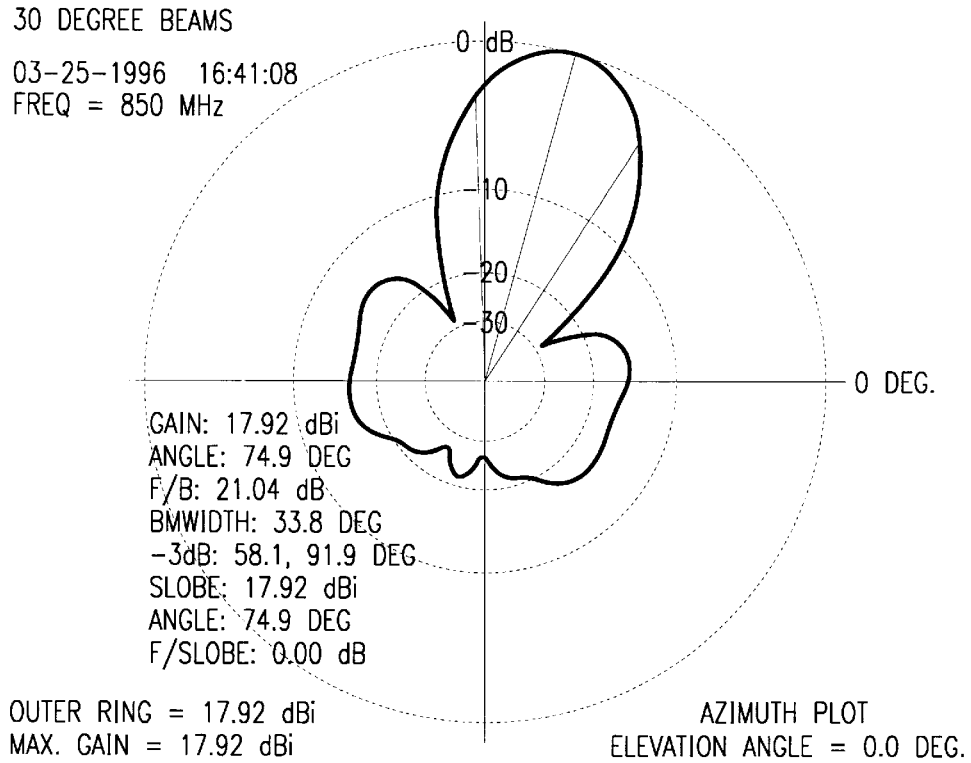
FIGS. 6*a*–6*c* are estimated azimuthal far-field radiation patterns using the method of moments with respect to the antenna shown in FIG. 1.
Figure 6B:
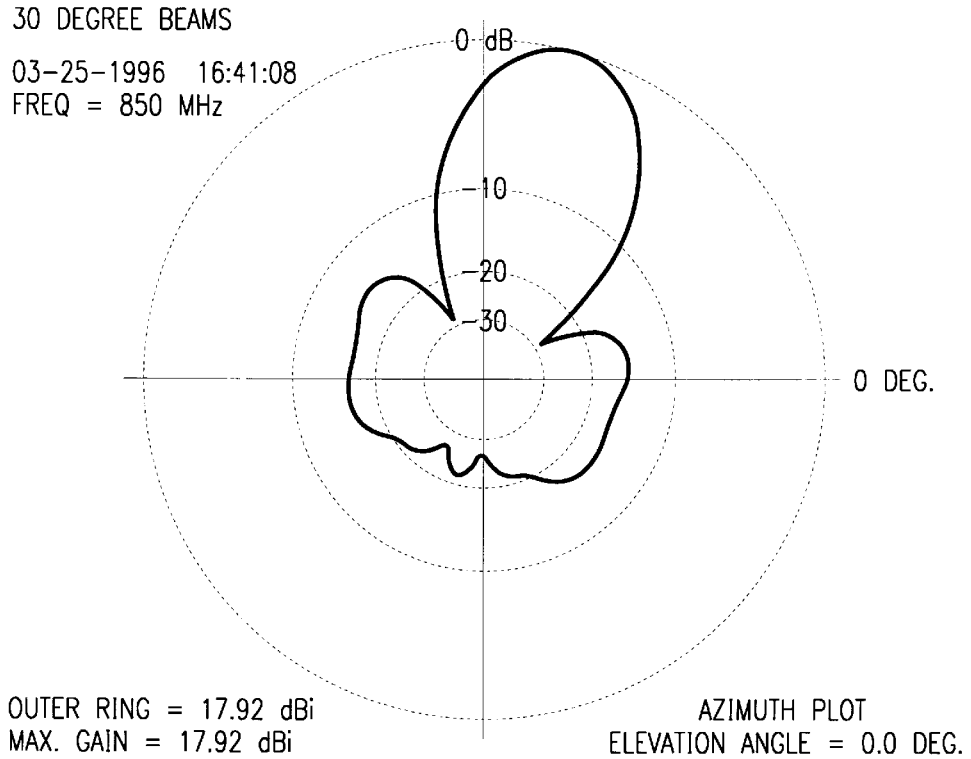

Thus far we have described how a wave front can be synthesized in the "first-degree", as shown in FIGS. 6*a* and 6*b.* A more sophisticated synthesis takes into account the effect of the divergence factors resulting from the outer column image sources and the presence of the curved conic surface effecting these image sources.

$$D = \text{divergence factor}$$

$$D = \frac{\text{reflected field curved surface}}{\text{reflected field flat surface}}$$

Figure 9A:
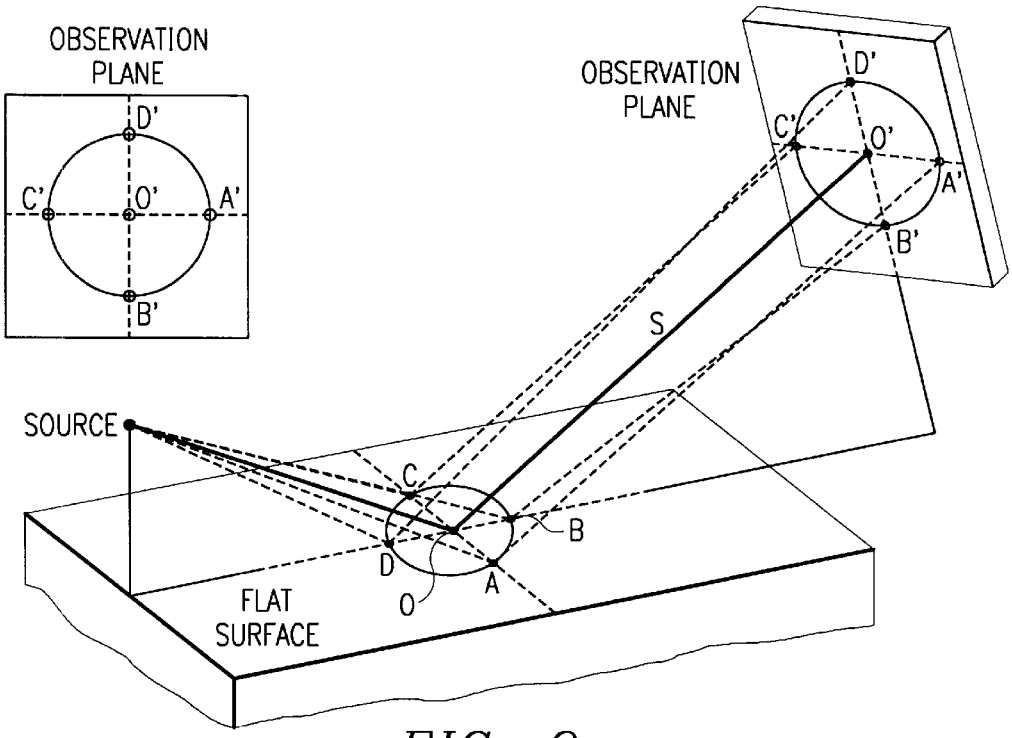
FIGS. 9*a* and 9*b* are diagrams illustrating reflections from a flat and a spherical surface, respectively.
Figure 9B:
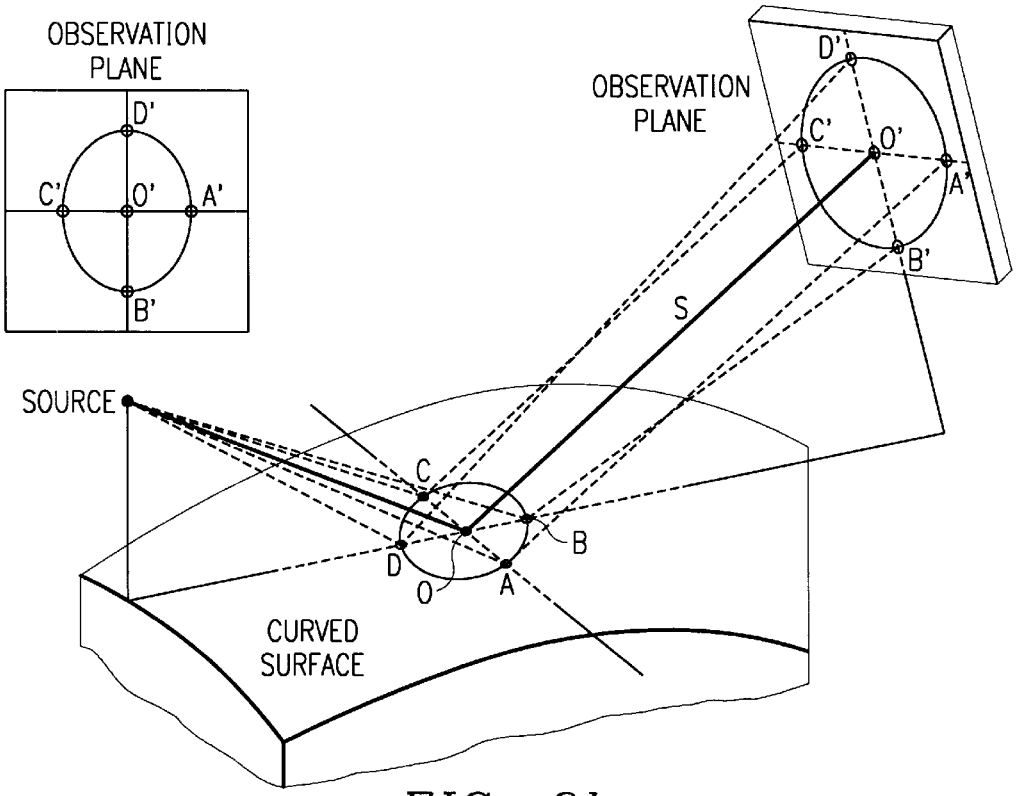
Figure 10:
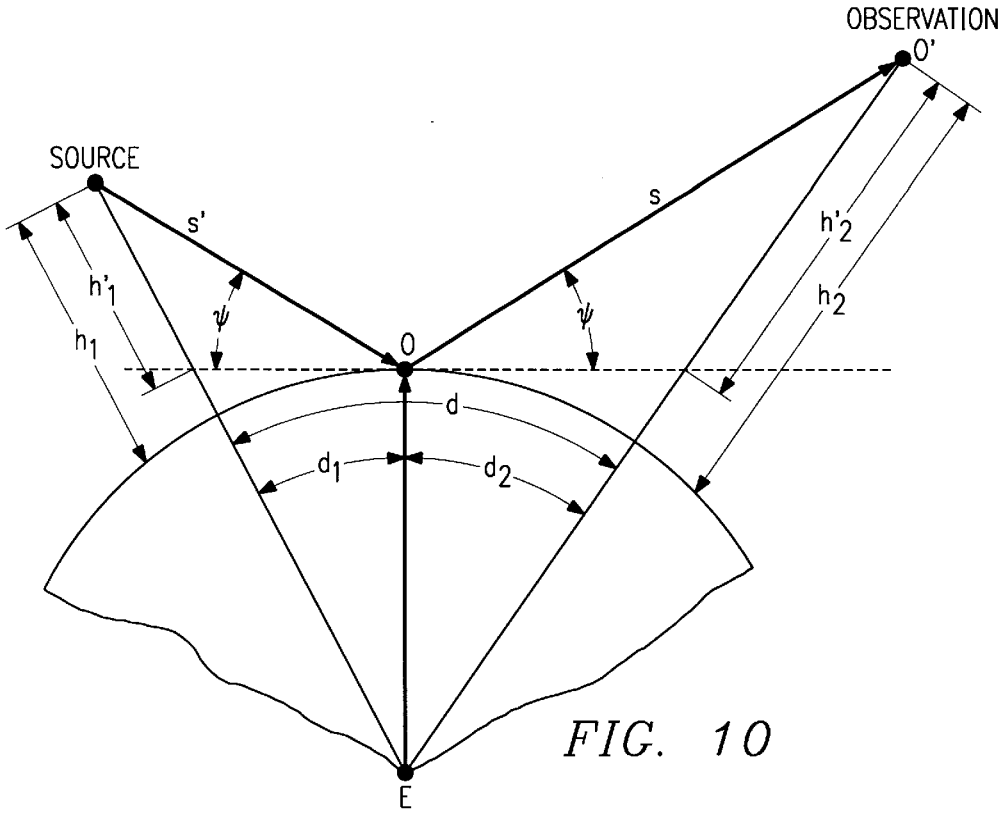
FIG. 10 is a diagram illustrating the geometry for reflections from a spherical surface.

The formula for D can be derived using purely geometrical considerations. It is accomplished by comparing the ray energy density in a small cone reflected from a sphere near the principal point of reflection with the energy density the rays (within the same cone) would have if they were reflected from a surface. Based on the geometrical optics energy conservation law for a bundle of rays within a cone, the reflected rays within the cone will subtend a circle on a perpendicular surface for reflections from a flat surface, as shown in FIG. 9*a.* However according to the geometry of FIG. 9*b,* it will subtend an ellipse for a spherical reflecting surface. Therefore the divergence factor can also be defined as $$D = \frac{E_s}{E_f} = \left[\frac{\text{area contained in circle}}{\text{area contained in ellipse}}\right]^{1/2}$$

where $E_s$=reflected field from spherical surface $E_f$=reflected field from flat surface Using the geometry of FIG. 10 and assuming that the divergence of rays in the azimuthal surface (glance vertical to the page) is negligible, the divergence factor can be written as $$D \cong \left[1 + 2*\frac{s's}{ad*\tan\psi}\right]^{-1/2}$$

where ψ is the grazing angle. Thus the divergence factor of the above takes into account energy spreading primarily in the elevation surface. When d<<a, then $$s' \cong \frac{h_{1'}}{\sin\psi}$$

$$\tan\psi \cong \frac{h_{1'}}{d_1}$$

$$s \cong \frac{h_{2'}}{\sin\psi}$$

$$\tan\psi \cong \frac{h_{2'}}{d_2}$$

For low grazing angles (ψ small), sin ψ≅tan ψ, $$D \cong \left[1 + 2*\frac{h_{1'}*h_{2'}}{a*d*\tan^3\psi}\right]^{-1/2} \cong$$

-continued $$\left[1+2*\frac{d_1^2*d_2}{a*d*h_{1'}}\right]^{-1/2} \cong \left[1+2*\frac{d_1^2*d_2^2}{a*d*h_{2'}}\right]^{-1/2}$$

$h_{1'}$=height of the radiating column above the cylinder surface (with respect to the tangent at the point of reflection)

$h_{2'}$=height of the observation point above the cylinder (with respect to the tangent at the point of reflection)

d=range (along the surface of the cylinder) between the source and the observation point a=radius of the cylinder.

ψ=reflection angle (with respect to the tangent at the point of reflection).

$d_1$=distance (along the surface of the earth) from the source to the reflection point $d_2$=distance (along the surface of the cylinder) from the observation point to the reflection point The divergence factor can be included in the formulation of the fields radiated by a horizontal dipole, in the presence of the cylinder, $$E_\psi = j\eta\frac{kI_0le^{-jkr}}{4*\pi*r}\sqrt{1-\sin^2\theta\sin^2\Phi}\,[e^{jkh\cos\theta}+DR_he^{-jkh\cos\theta}]$$

The divergence effect perturbs the value of phase delays and can be estimated by ray tracing, or the use of method of moments programs to effect the best value of delay based on what first side lobe level is desired as well as what target beam width is required by the designer.

The effect of the divergence is to produce a tapered aperture distribution as opposed to a rectangular aperture distribution when all columns are driven at unity and in phase, as in the case of a linear phased array system working in a broadside mode. As the radius of the cylinder increases, the value of the divergence factor increases as in the limit where the cylinder surface starts to converge into a flat surface. So, as the divergence factor decreases, the first side lobe level relationship decreases. As the divergence factor increases, so does the first side lobe level relationship.

We lose the beneficial effect of the divergence factor when the radius grows beyond $3\lambda/2$. In the case of the four driven columns, to compensate for this effect, a series attenuation is placed at the 0° ports of the 4-way combiner when used. The value of attenuation depends on what aperture distribution is desired. In the case of "N" driven column radiators, the series attenuation is placed on those ports that have the least phase shift. Typically, it is desired to have an aperture distribution that is of a raised cosine function. This is achieved by introducing the desired amount of series attenuation on the "lesser" phase shifted ports to the "N" combiner (this is the combiner that is connected to the radiator column). Any desired aperture distribution is accomplished this way, even in the rare case where the divergence factor hinders an arbitrary aperture distribution. The series attenuators can be placed at the appropriate "N" combiner port to effect the desired distribution. Thus, the far-field radiation pattern can be synthesized by the use of the natural divergence factor created by the conic and/or the use of series attenuators at the "N" combiner phase shift ports.

Figure 6C:
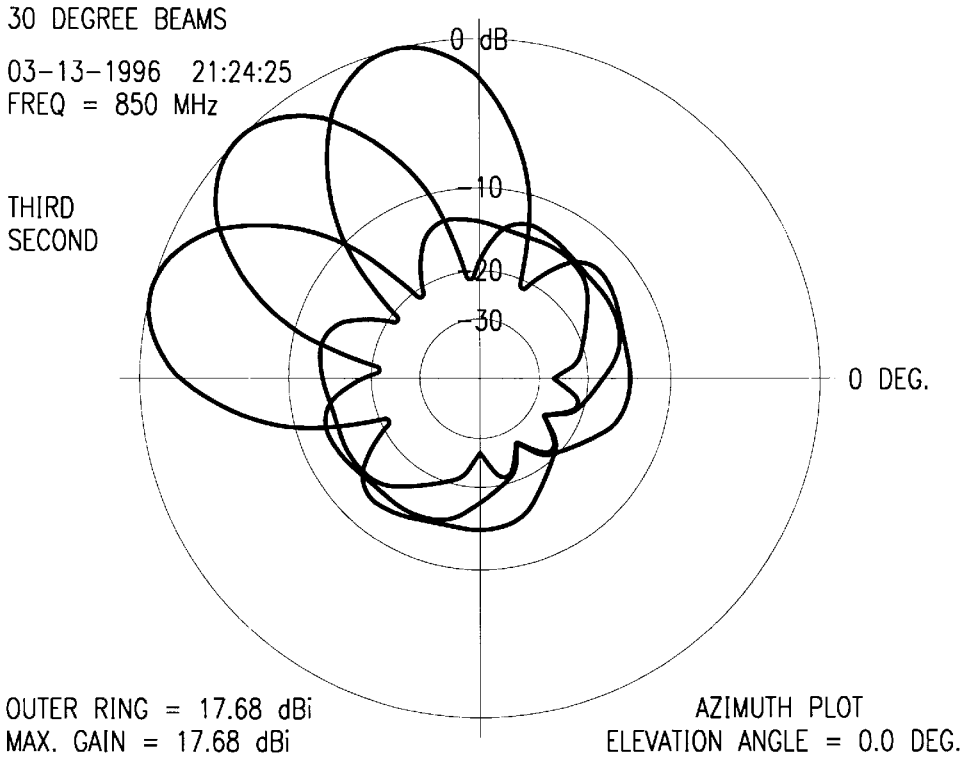

Since the radiator columns are identical around the circumference of the conic (cylinder in this example), the beams are identical to each other and only differ in the fact that the formed beams point in different azimuthal directions. This assumes that each column is set for the same $\theta_m$ or $\theta_e$ which controls or sets the elevation scan departure from normal, as discussed with respect to FIGS. 11*a* and 11*b*. FIG. 6*c* shows three adjacent beams superimposed to illustrate the absence of scan loss, i.e., the amplitude of each adjacent beam is the same independent of azimuthal direction, again, this is not the case with a planar array. Each of the beams are illuminated by exciting the designated input port of the phasing network (beam-forming), assigned to that particular beam/direction.

Figure 7A:
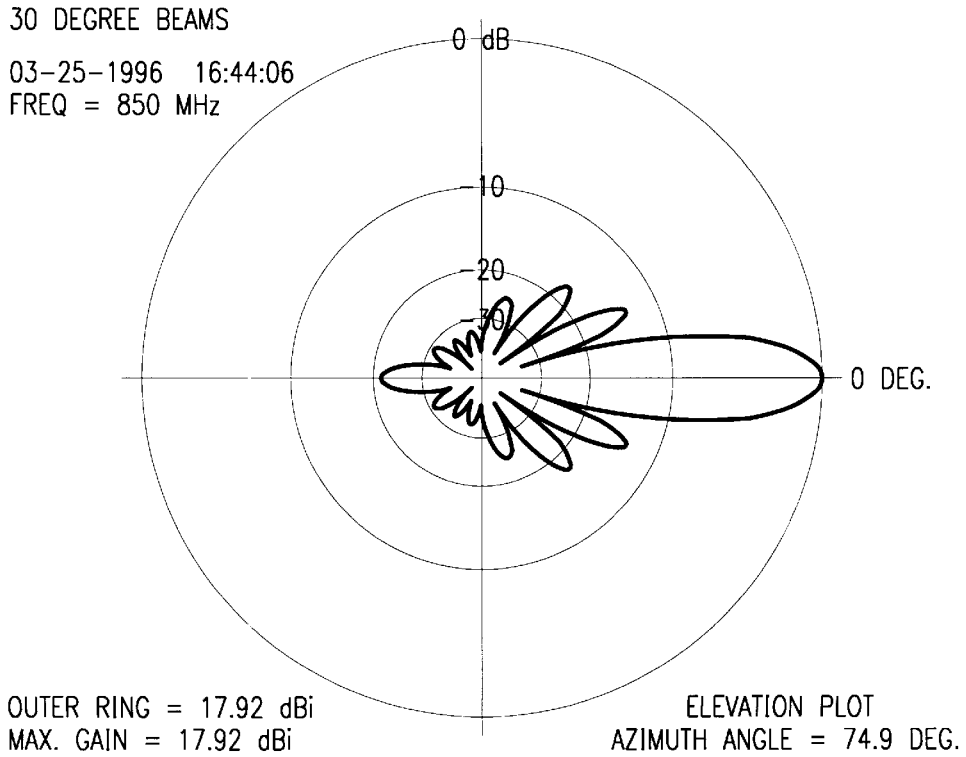
FIGS. 7*a*–7*b* are estimated elevation far-field radiation patterns using the method of moments with respect to the antenna shown in FIG. 1.
Figure 7B:
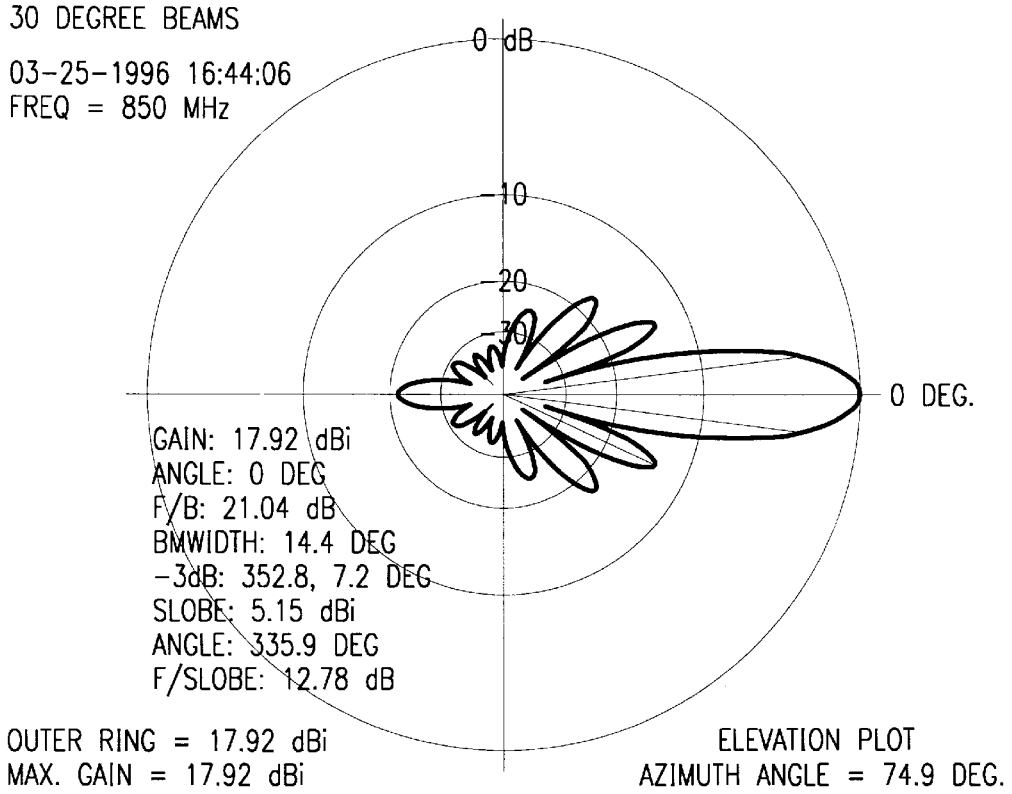
Figure 8A:
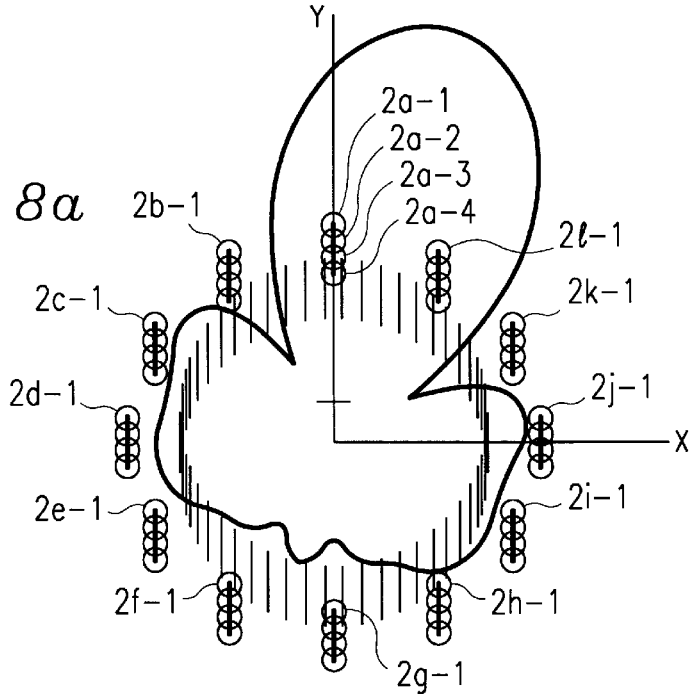

FIGS. 7*a* and 7*b* illustrate the elevation plot along the azimuthal direction of 74.9°, this is like a sectional cut along the beam peak of FIG. 6*a*. The side lobe suppression torus can control the side lobe levels in this plain. The side lobe levels as shown were created by an NEC (numerical electromagnetic code) program using a model illustrated in FIGS. 8*a*, 8*b*, and 8*c*. This model did not use a torus at the upper or lower cylinder edges, thus no side lobe level control in the elevation plain, FIGS. 7*a* and 7*b*, is in effect.

Figure 15A:
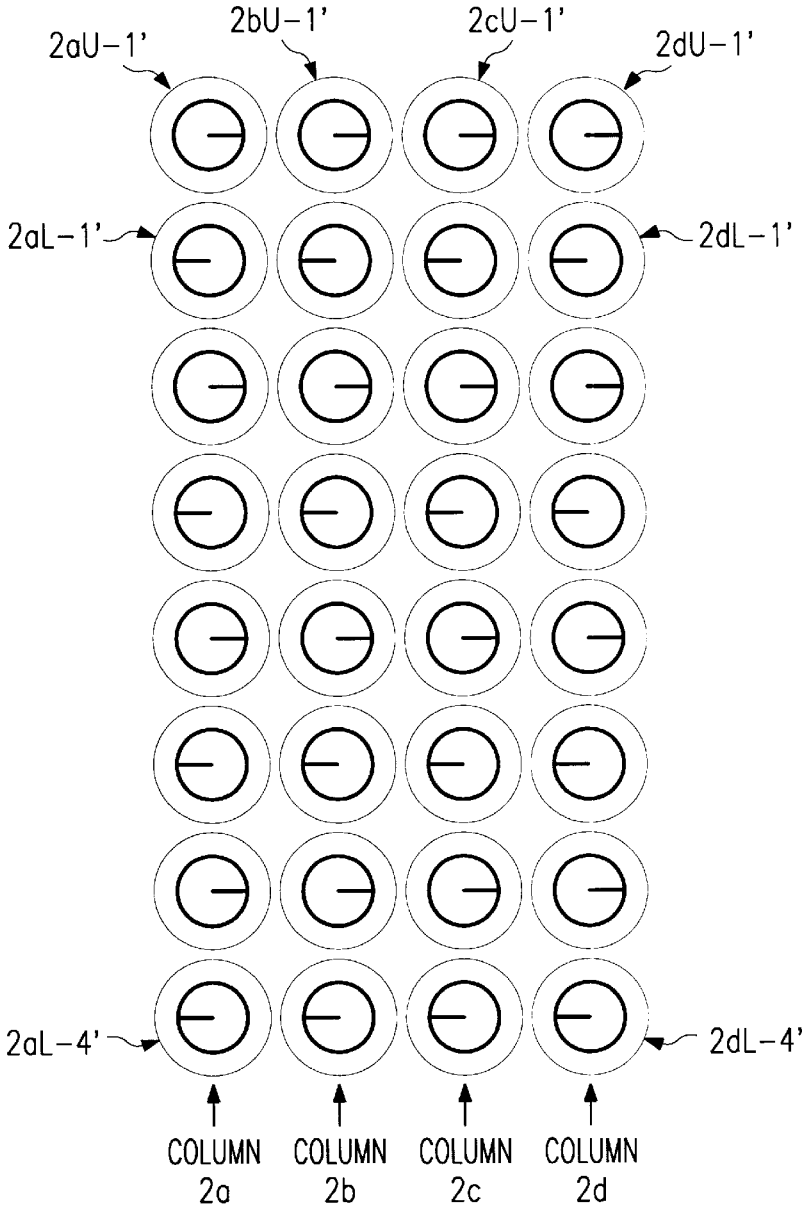
FIGS. 15*a*–15*c* show helical coil transmission structures.
Figure 15B:
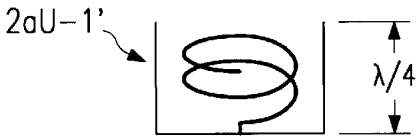
Figure 15C:
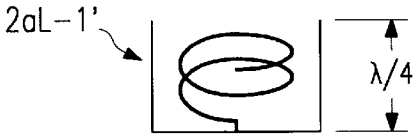

Returning again to the structure shown in FIG. 13 which illustrates a zig-zagged structure of the dipoles. This structure, as discussed, is more power efficient but it has lost the linear (vertical) polarization of the structure of FIG. 1 where all of the dipoles are oriented in the same direction. They go up and down. The zig-zagged structure has lost the linear polarization. We now have elliptical polarization and a subset of elliptical polarization is called circular polarization. This is created by a dipole which is laying sideways (or on a slant) and the backdrop for it is the cylinder. Note however, helical coils can substitute for the dipoles in the generation of circular polarization. This is shown in FIG. 15*a* where the coils are a direct replacement for the elements of FIG. 13. FIGS. 15*b* and 15*c* show oppositely directed coils as used in FIG. 15*a*. This is a fortuitous byproduct and is combined with an efficient power structure. The cellular industry started with mobile radios having antennas somewhere on the back or the top of a car. This antenna was vertically polarized. So a vertical antenna system was good. Now, however, cellular phones are truly mobile and the antennas are mounted on the telephone. Users hold the antenna diagonal to the ear so that the antenna is actually cocked at an angle which matches the angle at which the dipoles are cocked. Energy from the cocked dipoles of the interleaved antenna rotates as fast as the operating frequency. Thus, a person could be lying on his back or hanging from a tree and the circular polarization will pick up his/her signal. This is the same polarization as is used by FM radio stations in the 88 to 108 MHz band, which have been using circular polarization for the past 12 years. With the system devised herein, cellular radio will be able to use circular polarization.

Although the present invention and its advantages have been described in detail, it should be understood that various changes, substitutions and alterations can be made herein without departing from the spirit and scope of the invention as defined by the appended claims. For example, although FIG. 1 shows a transmitting structure, it could also be a receiving structure or receiving and transmitting structures could be interposed and could be of different designs. Also, the ground surface could be discontinuous at points around the periphery and the antenna design could be adjusted around the periphery for different transmission or terrain conditions.

What is claimed is:

1. An antenna system comprising:

a plurality of radiating structures spaced circumferentially around a center point;

a ground surface circumferentially located around said center point and between said center point and each of said radiating structures, said ground surface circumscribing a volume substantially perpendicular to a surface upon which signals transmitted from a radiating structure are to be received on; and a feed network coupled to each radiating structure of the plurality of radiating structures, wherein the feed network includes a plurality of signal interfaces each associated with a different antenna beam and each coupled to a different selected subset of the radiating structures.

2. The antenna system set forth in claim 1 wherein the ground surface is a truncated cone having an angle Θ with respect to the signal receiving surface.

3. The antenna system set forth in claim 2 wherein the angle Θ is variable.

4. The antenna system set forth in claim 1 wherein each of the radiating structures is a series of dipoles spaced parallel to the ground surface and along the longitudinal axis of the ground surface.

5. The antenna system set forth in claim 4 wherein the radiating structures are equidistant from each other.

6. The antenna system system set forth in claim 4 wherein the ground surface forms an angle Θ with respect to the signal receiving surface.

7. The antenna system set forth in claim 1 wherein at least the top or bottom edge of the ground surface forms a curved torus.

8. The antenna system set forth in claim 7 wherein the torus includes lossy material.

9. The antenna system set forth in claim 7 wherein the torus is curved inward.

10. The antenna system set forth in claim 1 wherein the ground surface is discontinuous at least one point around its circumference.

11. The antenna system set forth in claim 1 wherein a signal transparent radom covers the antenna system.

12. The antenna system set forth in claim 11 wherein at least some of the radiating structures are signal receiving structures.

13. The antenna system set forth in claim 12 wherein a signal shield forms two chambers within the volume of the ground surface.

14. The antenna system set forth in claim 13 wherein both chambers are contained within a single radom, all supported by a common mast extending through the longitudinal center of the antenna system.

15. The antenna system set forth in claim 13 wherein one of the chambers contains radiating structures and the other of the structures contains receiving structures.

16. The antenna system set forth in claim 1 wherein certain of the radiating structures have a first design and others of the radiating structures have a second design.

17. The antenna system set forth in claim 1 wherein the radiating structures are bidirectional receiving or transmitting.

18. The antenna system set forth in claim 1 wherein said radiation structures create circular polarization of a transmission signal.

19. The antenna system set forth in claim 1 wherein the activation of any one structure involves the activation of four adjacent structures.

20. The antenna system set forth in claim 19 wherein said four adjacent structures are controlled using Wilkinson and hybrid combiners in a non-interleaved mode with a loss of 3 dB of power.

21. The antenna system set forth in claim 19 wherein said four adjacent structures are controlled using Wilkinson and hybrid combiners in an interleaved mode with no loss of power.

22. The antenna system set forth in claim 21 wherein said interleaved mode includes a dual antenna array for each of the column structures.

23. The antenna system set forth in claim 22 wherein each of the dual antennas of each structure includes a plurality of individual radiator points, oriented to create an elliptical radiation pattern.

24. The antenna system set forth in claim 23 wherein each of the dual antennas of each structure includes a plurality of individual radiators in the form of helical radiators to create an elliptical pattern.

25. The antenna system set forth in claim 23 wherein the elliptical radiation pattern is circular.

26. The antenna system set forth in claim 1 wherein the feed network includes a first tier of Wilkinson combiners, a tier of hybrid combiners, and a second tier of Wilkinson combiners interconnected to provide a non-interleaved antenna system.

27. The antenna system set forth in claim 1 wherein the feed network includes a tier of Wilkinson combiners and a tier of hybrid combiners interconnected to provide an interleaved antenna system.

28. A cellular antenna comprising:

a plurality of antennas spaced apart from a next adjacent antenna an equidistance from a central point forming a circle around the central point; and means for controlling the phase relationship of a signal provided on a selected one of the antennas with respect to the same signal provided on ones of the antennas adjacent to the selected one antenna, wherein said phase relationship controlling means includes a plurality of signal interfaces each of which is associated with a unique preselected subset of the plurality of antennas, and wherein a different predefined narrowly focused antenna beam is formed with respect to signals associated with each signal interface.

29. The antenna set forth in claim 28 wherein the phase controlling means includes means for combining signals at the selected antenna and the next adjacent antenna such that the signals are in balanced quadrature with each other.

30. The antenna set forth in claim 28 wherein the phase controlling means includes means for combining signals at the selected antenna and the next adjacent antenna such that the signals are in unbalanced quadrature.

31. The antenna set forth in claim 30 wherein the phase controlling means includes the addition of a second antenna for each narrowly focused antenna.

32. The antenna set forth in claim 30 wherein the two antennas for each pair are arranged to provide circular polarization.

33. The antenna set forth in claim 30 wherein each antenna includes a plurality of radiating/receiving points, each having an established phase relationship with the signals transmitted on the other of the radiating/receiving points associated with the same antenna.

34. The antenna set forth in claim 33 further including means for changing the direction that a signal leaves a given antenna by changing the relative phase relationship of the points within a given antenna.

35. An antenna system having a plurality of radiating structures spaced circumferentially around a center point, each radiating structure spaced equidistant from and parallel to a next adjacent radiating structure, said system comprising:

a ground surface circumferentially located around said center point and between said center point and each of said radiating structures, wherein the ground surface has a top and a bottom edge and wherein each of these edges is rounded inward to form a side lobe suppressor torus; and means for phase shifting a transmission signal from certain activated ones of said activated radiating structures a selected delay amount, the phase shift amount being selected such that the transmission signal wave front leaving said certain activated radiating structures is in a relatively straight line substantially perpendicular to the direction of travel of said transmission signal.

36. The antenna system set forth in claim 35 wherein said phase shifting means comprises:

a feed network coupled to each radiating structure of the plurality of radiating structures, wherein the feed network includes a plurality of inputs each associated with an antenna beam and each coupled to a selected subset of the radiating structures, wherein the feed network includes a first tier of Wilkinson combiners, a tier of hybrid combiners, and a second tier of Wilkinson combiners interconnected to provide a non-interleaved antenna system.

37. The antenna system set forth in claim 35 wherein said phase shifting means comprises:

a feed network coupled to each radiating structure of the plurality of radiating structures, wherein the feed network includes a tier of Wilkinson combiners and a tier of hybrid combiners interconnected to provide an interleaved antenna system.

* * * * *